United States Patent [19]

Woodgate

[11] Patent Number: 4,644,894

[45] Date of Patent: Feb. 24, 1987

[54] ANCHOR

[76] Inventor: Bryan F. Woodgate, 2 Penluke Close, Four Lanes, Redruth, United Kingdom

[21] Appl. No.: 698,338

[22] Filed: Feb. 5, 1985

[51] Int. Cl.[4] ..... B63B 21/038

[52] U.S. Cl. ..... 114/304

[58] Field of Search ..... 114/294, 297, 298, 299, 114/301-304

[56] References Cited

U.S. PATENT DOCUMENTS

| | | | |
|---|---|---|---|
| 2,789,526 | 4/1957 | Gollner | 114/298 |
| 3,593,682 | 7/1971 | Zitzow | 114/298 |
| 4,134,355 | 1/1979 | Carruthers | 114/304 |

*Primary Examiner*—Trygve M. Blix
*Assistant Examiner*—Jesûs D. Sotelo
*Attorney, Agent, or Firm*—Gifford, Groh, VanOphem, Sheridan, Sprinkle and Dolgorukov

[57] ABSTRACT

An anchor comprises an anchor shaft member and an anchor body member in the form of a plate having two blades which are joined to the anchor shaft member by a pivotal connection which allows the blades to lie normally within a range of angles to the plane containing the anchor shaft and the pivot axis. This range of angles is determined by the interconnection between two lugs on the anchor body member projecting away from the pivot axis on the opposite side from the main plate constituting the anchor shaft to enable the anchor to lodge against the submarine obstruction in the usual way: the relative inclination of the anchor body member and the anchor shaft member can be changed by applying a force greater than that required to effect shearing of the shear pin so that the anchor shaft member can swing freely about the pivot with respect to the blade to allow release of the anchor.

8 Claims, 3 Drawing Figures

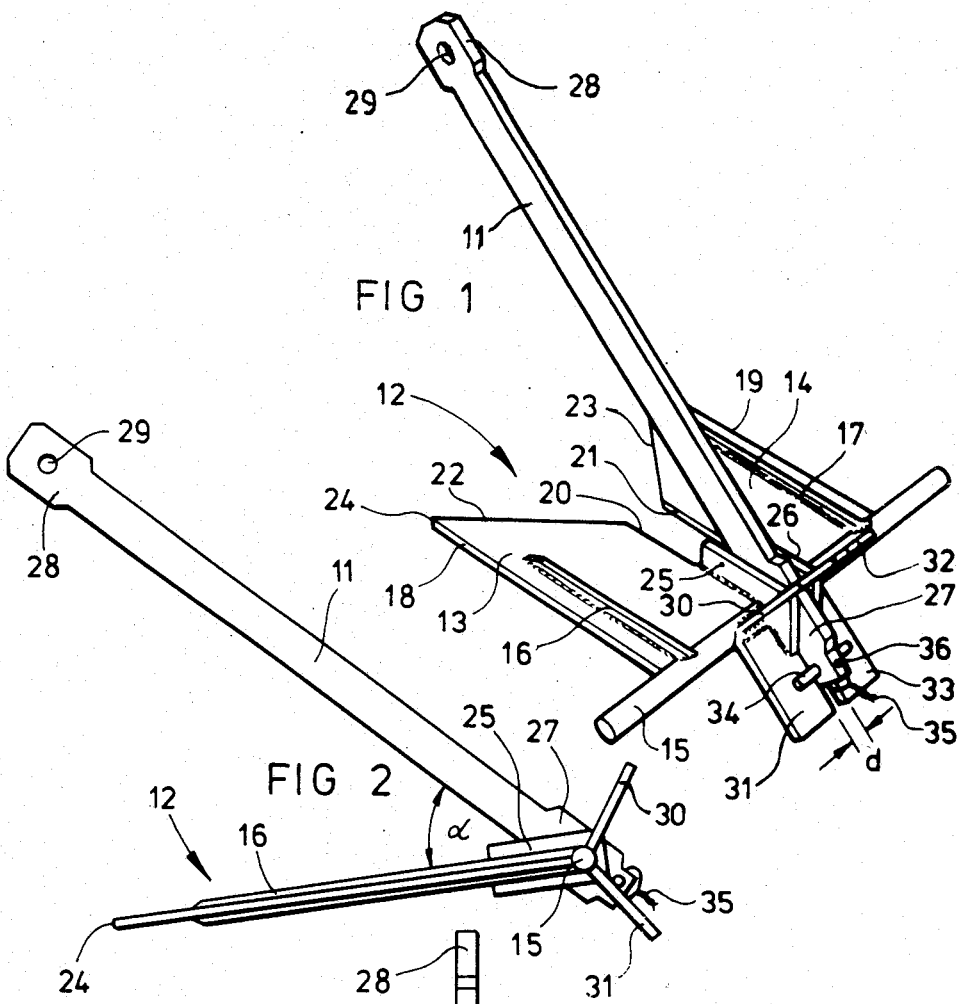
FIG 1
FIG 2
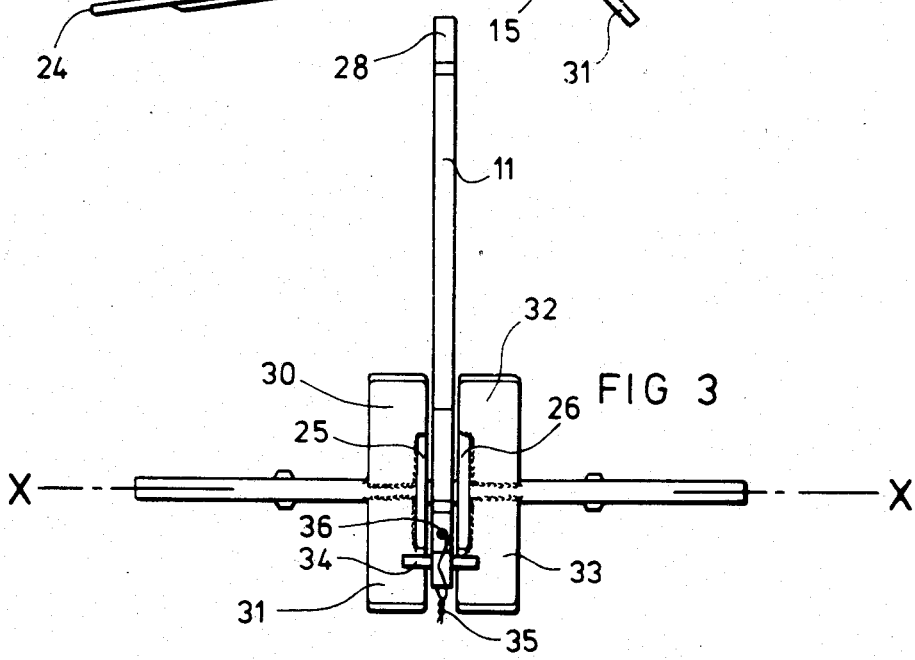
FIG 3

ANCHOR

BACKGROUND OF THE INVENTION

The present invention relates to an anchor. The principles of the invention can be applied to anchors of any size.

A problem which is often encountered when using an anchor is the inability to release an anchor which has become lodged or jammed on a submarine obstruction on the sea bed or river bed. Because a vessel, particularly a small boat can exert only a relatively small traction there is usually no alternative but to cut the anchor free and discard it. Anchors, however, are expensive items and this practice is wasteful and uneconomic. Considerable attention has been given to the problem of enabling release of a jammed anchor. The problem is exacerbated by the fact that satisfactory anchoring frequently actually requires that the anchor be lodged or jammed on something on the sea or river bed, so that anchors are shaped specifically in order to catch against any such obstruction. Obviously however, this engagement with a submarine obstruction should be releasable when it is desired no longer to hold the boat fast in a particular location to allow it to depart.

One prior art attempt to solve this problem has included the use of a secondary line between the boat and the chain, operative when pulled to raise the anchor and seek to change its orientation. In many circumstances, however, when the anchor blades or tines are lodged securely, particularly against rock or weed, no amount of tension on the secondary line can effect the necessary release.

Another attempt to solve this problem has involved the use of a slotted link connection between two parts of an anchor which are relatively movable. The theory in this case is that if the anchor is moving in one direction when it jams, then by sailing or driving the boat in the opposite direction and allowing the two relatively movable parts to slide along the slotted connection so that the opposite end of the slot is engaged, then release of the jammed part of the anchor may be effected. Again, in practice, this has been found to be impractical partly because of the force with which jamming can take place, and partly because the relatively fixed orientation of the jammed part means that a greater twisting force is applied to the anchor when the anchor chain is pulled in any but the original direction it was travelling in when the jamming took place, and, of course, it is totally impossible to release a jammed anchor by applying a greater tension in the original direction.

OBJECTS OF THE INVENTION

The primary object of the present invention is to provide a solution to the above-stated problem with an anchor having two relatively pivoted parts and means by which the two parts can be allowed to pivot to release the anchor when it is jammed.

Another object of the invention is to provide a releasable anchor as in the first object, in which the two pivoted parts are prevented from turning in normal use to encourage the original engatement which holds the boat anchored.

SUMMARY OF THE INVENTION

According to one aspect of the present invention, therefore, an anchor for nautical or marine use comprises an anchor body member, means pivotally connecting said anchor body member to said anchor shaft member for turning movement with respect thereto, and retaining means for retaining said anchor body member in a position in which it is inclined to the anchor shaft at not more than a predetermined angle, said predetermined angle being determined by said retaining means, said retaining means being releasable whereby to allow said anchor body member and said anchor shaft member to turn relative to one another about said pivotal connection means.

The release of the anchor body member may be effected by any one of a number of arrangements. For example release may be effected by means of a secondary line working a latch or catch which holds the anchor body fixed in relation to the shaft; alternatively release of the anchor body may take place upon the occurrence of a relative turning moment about the pivot axis above a predetermined maximum value, for example to shear a shear pin. Further release devices may include a triggerable explosive charge operating to fracture a retaining member like a shear pin.

In a preferred embodiment of the invention relative turning movement of the anchor body and the anchor shaft takes place about an axis extending transverse the length of the shaft between a first position in which the body lies on one side of the plane defined by the shaft and the said axis and a second position in which the body lies on the other side of the said plane. This ensures that whatever the orientation of the anchor body when it strikes the sea or river bed the anchor shaft can rise to a given angle with respect to the anchor body. The first and second positions are therefore preferably symmetrical about the said plane.

If the anchor body member is restricted in its turning movement about the anchor shaft member by a shear pin projecting from the anchor body member or the anchor shaft member then this latter acts to engage the anchor shaft member or the anchor body member respectively, to limit turning movement of the anchor body member and the anchor shaft member to the normal operating range. When the predetermined force constituted by the shear strength of the pin is exceeded, however, for example if the anchor is jammed and the anchor chain is drawn tight then the shear pin fractures and the body member and the shaft member are allowed to rotate with respect to one another so that, either the anchor body member can turn to become released from its jammed location, or alternatively the anchor shaft member can turn to a position where a tension can be applied via the anchor chain to draw the anchor body member out from its jammed location.

The shear pin is fitted to the anchor shaft member on the side of the said axis remote from a fixing eye for a shackle by which the anchor is attached to the anchor chain, and there may be provided two lugs on the anchor body member for engaging the shear pin in each of the said two end positions. Ideally the shear pin projects on both sides of the anchor shaft and there are provided two pairs of such lugs defining the end positions of the anchor body member in its pivotal movement about the anchor shaft member.

As intimated above, it is preferred that the anchor body is a generally planar member, and in the preferred embodiment it has two blades one on each side of the anchor shaft. Each blade may have a first edge generally perpendicular to the pivot axis and a second edge inclined at an acute angle to the first. The anchor thus effectively has a V-shape notch or recess spaced by the two pointed ends of the blades defined at the forward end of the blades at the junction of the above described two edges. For this purpose the said first edge of each blade is the edge furthest from the corresponding said edge of the other blade. The inclined edges, correspondingly, are adjacent one another and meet or approach approximately at the centreline of the anchor.

The said lugs extend at an angle to the general plane of the anchor body such that, in the said end position with a lug in contact with the shear pin, the anchor shaft lies at an angle to the general plane of the anchor body of between 30° and 40°. The lugs also serve a secondary purpose in that when the anchor rests on the sea or river bed, the contact points with the bed are the ends of the lowermost lugs and the ends of the blades. The blades are therefore held at a predetermined angle, in the region of 5° to 25° (to the horizontal) thereby encouraging the anchor to bite into the surface of the sea bed to anchor the boat securely in conditions where the sea bed is mud or shingle.

Of course, the strength of the shear pin can be adjusted to suit either different conditions or different boats so that a given anchor can be adapted for particular purpose. In order to achieve this the shear pin is removed and either replaced with one of the a different diameter or a different material to obtain a different shear strength, or a section of the original pin can be turned down on a lathe to a smaller diameter if it s required to reduce its strength.

In practice the shear pin is retained in position on the anchor shaft by a metal wire passing through a hole in the shear pin and aligned holes in the anchor shaft.

In order to encourage the anchor to lie with the plate or blade part generally parallel to the sea bed, inclined only by the elevation of the pivoted end due to contact of the lugs with the sea bed, the anchor body member preferably includes axial projections in the plane of the body and aligned with or at least parallel to the said axis, the said projections thus act to ensure that the anchor lies on the sea bed with the axis parallel thereto rather than at an angle thereto.

Release of the said retaining means can alternatively be achieved by acting on a connecting line extending from the anchor along the anchor chain to an operator's position, by means of which the interconnection between the anchor body member and the anchor shaft member can be released to permit unrestricted relative turning movement of the said two members. Such retaining means may be mechanically releasable, in which case the said connecting line is arranged to effect mechanical release thereof when a tension is applied thereto. Other embodiments are possible, however, in which different release mechanisms are operative. For example, the said retaining means may be electrically or magnetically releasable and the said connecting line is adapted to transmit an electrical signal to a release mechanism for energisation thereof to effect release of the retaining means.

An electrical signal may also be used in the case of a frangible element being used instead of the shear pin if, for example, the fracture of the frangible element is effected by means of an explosive charge housed in the anchor and detonated by means of a signal transmitted along the said connecting line.

Various other features and advantages of the invention will become apparent from a detailed study of the following description which is provided purely by way of non-limitative example only.

BRIEF DESCRIPTION OF THE DRAWINGS

FIG. 1 is a perspective view of an anchor with a flat plate blade constituting an embodiment of the invention;

FIG. 2 is a side view of the embodiment illustrated in FIG. 1; and

FIG. 3 is an end view of the embodiment of FIGS. 1 and 2 as seen in the direction of the arrow A of FIG. 1.

DESCRIPTION OF THE PREFERRED EMBODIMENT

Referring now to the drawings the anchor shown comprises an anchor shaft generally indicated 11 and an anchor plate generally indicated 12 pivotally connected together about an axis X—X (FIG. 3).

The anchor plate is effectively formed of two parts 13, 14 which are joined together by a pivot shaft 15 welded securely to each of the blades 13,14 along one edge thereof, so as to hole the two blades 13,14 in a coplanar and parallel orientation. Each of the blades 13, 14 has a reinforcing rib 16,17 respectively extending parallel to a long edge 18,19 respectively of the blade 13,14; the long edges 18,19 being oriented parallel to one another and perpendicular to the length of the shaft 15.

Opposite the long edges 18,19 each of the blades 13,14 has a respective short edge 20,21 parallel to the respective long edge 18,19; and on the end remote from the end connected to the pivot shaft 15 each blade has an inclined forward edge 22,23 respectively joining the long edge 18,19 at an acutely angled corner only one of which, namely the corner on the blade 13 at the junction of the edges 18,22 can be seen in the drawings. This has been identified with the reference numeral 24.

The blades 13,14 are each provided along their inner edges 20,21 with transverse plates 25,26 which lie in a plane perpendicular to the general plane of the anchor plate 12 and the line of the pivot shaft 15, and project rearwardly of the blades 13,14 by a small amount so that the pivot shaft 15 passes through each of these transverse plates 25,26. The two transverse plates 25, 26 define a narrow interspace the width of which is very slightly greater than the thickness of the anchor shaft 11. This latter has an enlarged end 27 through which the pivot shaft 15 extends to join the anchor plate 12 to the shaft 11 and which projects beyond the pivot axis X—X. At its other end the anchor shaft 11 has an enlarge ring or eye 28 having an opening 29 which receives a shackle coupling to attach the anchor chain thereto.

Also secured to the pivot shaft 15 and to the transverse plates 25,26 are two pairs of inclined lugs 30,31 and 32,33. The two ludgs 30,32 are coplanar with one another and have inner edges spaced by the same distance as the inner faces of the transverse plates 25,26. Likewise, the two lugs 31,33, are coplanar and likewise spaced by the same interspace distance to define a gap corresponding to the spacing between the inner faces of the transverse plates 25,26. Finally, the enlarged head 27 of the anchor shaft 11 carries a transverse shear pin 34 which passes through a hole in the enlarged head 27 and is secured in position by a twisted wire 35 which passes through a hole 36 in the enlarged head 27 of the anchor shaft and a corresponding hole (not shown in the shear pin 34).

The inclination of the lugs 30,31 (and 32,33) in relation to the general plane of the anchor plate 12 is chosen, in relation to the distance between the pivot shaft 15 and the shear pin 34 such that the anchor shaft 11 can pivot about the pivot shaft 15 in relation to the plane of the anchor plate 12 between the first position, in which it is illustrated in the drawings, where the shear pin 34 is in contact with the lugs 31,33 and the angle $\alpha$ between the anchor shaft and the anchor plate is about 40°, and a corresponding position with the anchor plate on the other side of the anchor shaft 11 and the shear pin 34 in contact with the lugs 30,32.

In use of the anchor described above, the shear pin 34 prevents the anchor plate 12 from turning to a greater angle than that illustrated in FIG. 2 on either side of the anchor shaft 11 so that, although the anchor shaft 11 may lie at a smaller angle it will not normally move to a greater angle. When the anchor is lowered it may rest on the sea or river bed in the orientation illustrated in FIG. 2, for example, where the lugs 31,33 are in contact with the bed and the tips 24 of the blades 13, 14 also lie on the bed so that the plane of the blades 13, 14 is inclined at between 10° and 15° to the horizontal. As the anchor is dragged along the sea bed (and the term sea bed will be used exclusively hereinafter, although it will be appreciated that the anchor may equally be used on a river bed) until either the tips 24 engage into the bed itself if this is a soft material such as mud or shingle, or until the blades 12,13 catch against an obstruction such as a rock or thick seaweed. In such circumstances a clockwise turning moment about the tips 24 due to the tension applied at the eye 29 of the anchor shaft 11 by the anchor chain may cause the blade 13, 14 to rise to a greater angle than that illustrated in relation to the sea bed. For example, continued tension may cause the anchor shaft to adopt a horizontal orientation with the anchor blades 13, 14 at, for example 40° to the horizontal, in which orientation the anchor may be jammed by the tip 24 being located under a rock. It will be appreciated that in most cases an end portion of the anchor chain itself will be lying on the sea bed so that the anchor experiences a horizontal traction force.

The inclined edges 22, 23 ensure that the anchor tends to centralise on an individual obstruction with the narrow slot between the parallel edges 20, 21 acting to ensure that any upwardly enlarged obstruction such as a growth of seaweed or the like will be trapped and engaged by the anchor to anchor the boat in position.

If, when the anchor lands on the sea bed it is, for example in the same orientation as illustrated in FIG. 2, but the anchor chain is drawing the anchor shaft from left to right instead of from right to left as in the previously described case, the lugs 31, 33 will engage the sea bed and the anchor plate, as well as the shaft 11 can turn about the pivot shaft 15 which, as will be seen particularly from FIGS. 1 and 3, extends laterally of the blades 13, 14 to ensure that the pivot axis is generally parallel with the sea bed, to a position which is effectively a mirror image of the position illustrated in FIG. 2 with the shear pin 34 in contact with the lugs 30, 32 and the blades 13, 14 on the opposite side of the anchor shaft 11 from that illustrated in the drawings. This pivotal movement makes in unnecessary for any slewing action of the anchor to take place.

Now, considering the case where the anchor blades 13, 14 have been securely jammed by rocks or seaweed to such an extent that attempted displacement with the anchor in the orientation shown has not achieved release. It will be appreciated that the only force which can be applied to the anchor from the boat at the surface is transmitted through the anchor chain to the enlarged end 28 via the eye 29 on the anchor shaft 11. In an anchor of conventional design, where the relative orientation of the anchor plate and the anchor shaft 11 is fixed, any force which can be applied at the eye 29 cannot cause the plate 12 to move in the reverse direction to that in which it was moving when the jamming action took place. To understand this it must be imagined that the anchor illustrated in FIG. 2 is moving from right to left, in which case the tension on the anchor chain is being transmitted through the anchor shaft 11 as tension and the force on the anchor plate transmitted through the shaft 15 is partly a linear force parallel to the plate and partly a turning moment in an anti-clockwise sense about the tip 24. If, in order to reverse this movement, the boat moves in the opposite direction so that the force transmitted by the anchor chain to the eye 29 is in a direction from left to right (and almost inevitably including an upward component which, for the present purposes will be ignored since this only exacerbates the situation) the force transmitted from the chain to the anchor shaft 11 is a turning moment about the pivot shaft 15 tending to cause the tip 24 to rise. Because the original engaging force included an anti-clockwise turning moment about the tip 24, this clockwise turning moment will not assist in releasing the jammed anchor and normally only increases the jamming force. In order to release the jammed anchor plate 12 it would be necessary to apply the reverse force, generally parallel to the plate 12, without the turning moment which is inevitably applied because the pivot shaft end of the anchor is in contact with the sea bed and turned in a clockwise direction by the anchor shaft 11. Even if a direct upward tension is applied at the eye 29 this cannot release a conventional jammed anchor since the tip 24 of the blades 13, 14 is usually engaged underneath an obstruction which cannot be raised.

This problem is solved in a simple manner by the construction of the invention as described since, by applying a force greater than the shear strength of the shear pin 34 this pin shears through to allow the anchor shaft 11 to turn to any desired orientation in relation to the plate 12. Now, if the anchor chain is moved in the reverse direction from the engaging movement, namely from left to right, the anchor shaft 11 can be turned about the pivot shaft 15 until it lies itself on the sea bed in an effectively straight line with the plate 12. Continued tension on the eye 29 will now act to draw the anchor plate out from its jammed location without any turning moment being applied to the anchor platel due to the fact that the pivot shaft 15 is now freely turnable about the anchor shaft 11. The shearing tension can be applied simply by drawing the anchor chain upwardly or in an upward and inclined direction (upward and to the right as viewed in FIG. 2) and it is only this deliberate tension which causes the shear pin 34 to shear whereas the forces which may have been exerted by the anchor when it was required to hold fast can be transmitted to the vessel via the anchor shaft 11 with this in an orientation lying between that illustrated in FIG. 2 and one in which the anchor shaft 11 lies at a smaller angle to the blades 13, 14 in which orientation the shear pin 34 is spaced from the lugs 31, 33 or 30, 32 and is therefore not subjected to any shear force. Even as anchor chain tension much greater than that required to shear the fin 34 can thus be applied to the anchor in retaining the vessel without releasing the anchor. When anchor release movement is required, however, if the anchor does not come free from the obstruction normally, it is only necessary to position the vessel directly above the anchor and to draw the anchor chain tight until a force greater than the shear strength of the pin 34 is applied.

In this way, although the shear pin 34 is destroyed, the anchor can be saved and the relative cost of the shear pin and the whole anchor is obviously totally insignificant.

What is claimed is:

1. In an anchor for nautical or marine use, of the type having a pair of spaced anchor flukes each having a pair of parallel faces thereon extending substantially in a single plane, and comprising:

an elongate anchor shaft member having a first end for attachment of said anchor to an anchor chain and a distal end remote therefrom, an anchor body member incorporating said two spaced coplanar anchor flukes, means pivotally connecting said anchor body member to said anchor shaft member for turning movement with respect thereto, and shear pin retaining means for retaining said anchor body member in a position in which it is inclined to said anchor shaft member at not more than a predetermined angle, said predetermined angle being determined by engagement of said shear pin retaining means with cooperating abutment means, the improvement wherein said pivotal connection between said elongate anchor shaft member and said anchor body member is formed at a position along said elongate anchor shaft member spaced from said distal end thereof such that a distal end portion of said elongate anchor shaft member extends from said pivotal connection of said anchor shaft member and said anchor body member to said distal end of said anchor shaft member, said shear pin retaining means comprise a single shear pin passing through an aperture in said elongate anchor shaft member at a point between said pivotal connection to said anchor body member and said distal end and projecting on each side of said anchor shaft member, and said abutment means includes two pairs of abutment plate members each pair extending rearwardly away from said flukes of said anchor body member and said two pairs forming between them a V-shape, plate members of each said pair being coplanar and parallel to one another and spaced by a gap only slightly larger than the thickness of said distal end portion of said elongate anchor shaft member such that said plate members and said anchor shaft members together act to exert a shear force on a said shear pin when said anchor body member is turned about said pivotal connection to said elongate anchor shaft member to bring said shear pin into contact with one or other of said pairs of spaced parallel abutment plate members

2. The anchor of claim 1, wherein each said fluke has a first edge generally perpendicular to the pivot axis of said pivotal connection between said anchor shaft member and said anchor body member and a second edge inclined at an acute angle to said first edge, said first edges of said flukes being the edges furthest from one another, and said second, inclined edges, being those edges adjacent one another.

3. The anchor of claim 2, wherein said anchor body member includes axial projections in the plane of said body member and aligned with the axis of said pivotal connection of said anchor shaft member and said anchor body member.

4. The anchor of claim 1, wherein said pairs of abutment members extend at an angle to the general plane of said anchor body member flukes such that in each end position with a pair of abutment members in contact with said shear pin said anchor shaft member lies at an angle to the general plane of said anchor body member of between 30° and 40°.

5. The anchor of claim 1, wherein said shear pin is removable and can be replaced by a shear pin having a different shear strength.

6. The anchor of claim 5, wherein said shear pin is retained in position on said distal end portion of said anchor shaft member by a metal wire passing through a hole in said shear pin and aligned holes in said distal end portion of said anchor shaft member.

7. The anchor of claim 1, wherein said pairs of abutment plate members project from the general plane of said flukes of said anchor body member by a distance such that they hold said anchor body member with the plane of said flukes inclined with respect to a horizontal surface with the tips of said flukes and the ends of said abutment plate members in contact therewith at an angle of between 5° and 28°.

8. The anchor of claim 1, wherein said anchor body member includes axial projections in the plane of the body and aligned with the axis of said pivotal connection of said anchor shaft member and said anchor body member.

* * * * *